United States Patent [19]

Kelly

[11] 4,236,344

[45] Dec. 2, 1980

[54] TOY WITH SPRING-OPERATED SPEED REGULATED MOTOR MECHANISM

[75] Inventor: William J. Kelly, Torrance, Calif.

[73] Assignee: Mattel, Inc., Hawthorne, Calif.

[21] Appl. No.: 966,166

[22] Filed: Dec. 4, 1978

[51] Int. Cl.[3] ..... A63H 17/12

[52] U.S. Cl. ..... 46/40; 414/719; 414/913; 414/915

[58] Field of Search ..... 46/40, 39, 44; 188/317; 414/913, 915, 719

[56] References Cited

U.S. PATENT DOCUMENTS

| | | | |
|---|---|---|---|
| 1,838,876 | 12/1931 | Shonnard | 188/317 X |
| 1,955,457 | 4/1934 | Gaver | 46/40 |
| 2,589,333 | 3/1952 | Brown | 46/40 |
| 2,702,963 | 3/1955 | Swenson | 46/40 |
| 3,161,987 | 12/1964 | Decker | 46/40 |
| 3,462,874 | 8/1969 | Pauly et al. | 46/40 |
| 3,481,067 | 12/1969 | Cooper | 46/202 |

*Primary Examiner*—F. Barry Shay

*Attorney, Agent, or Firm*—John G. Mesaros; Max E. Shirk; Ronald M. Goldman

[57] ABSTRACT

A toy having a pivotable component in the form of a construction wheel loader having a shovel, the toy including a manually actuable handle cocking a spring coupled to a slidable member having a rack portion for operating the shovel. Movement of the slidable member during cocking of the handle simultaneously moves a coupler connected to a piston slidable axially within a stationary closed ended cylinder. The piston has a minute aperture in the face thereof with a larger aperture in the skirt thereof with the apertures being on opposite sides of the piston seal. A locking lever coacts with the coupler for retaining the parts in the powered position against the force of the spring. Manual release of the locking lever permits the spring to urge against the slidable member with the two apertures in the piston providing speed regulation during movement of the piston into the cylinder for moving the slidable member gradually.

12 Claims, 5 Drawing Figures

TOY WITH SPRING-OPERATED SPEED REGULATED MOTOR MECHANISM

BACKGROUND OF THE INVENTION

The background of the invention will be discussed in two parts:

1. Field of the Invention

This invention relates to spring operated and speed regulated mechanical motor mechanisms for use in toys or the like.

2. Description of the Prior Art

Toys in the form of construction equipment provide a constant source of amusement for children, such toys taking the form of steam shovels, dump trucks, and the like. A toy power shovel such as that shown in U.S. Pat. No. 1,955,457 is provided with suitable cabling and wheels operable by handles for actuating the lifting of the power shovel and release of the lower trap door for releasing dirt accumulated therein. Another such device utilizing cables and pulleys is shown in the form of a toy hoisting truck in the U.S. Pat. No. 2,589,333 which may be used by a child playing in sand or dirt or the like.

Other similar type construction toys have utilized winches operable by rotation of handles for winding cord connected over pulleys to the operable elements of the shovel or scoop or the like.

It is an object of the present invention to provide a new and improved construction toy.

It is another object of the present invention to provide a new and improved spring operated speed regulated motor mechanism for use in toys having mechanically operative parts.

It is still another object of the present invention to provide a new and improved spring powered motor mechanism providing a smooth transfer of power for actuating movable mechanical components of a toy.

SUMMARY OF THE INVENTION

The foregoing and other objects of the invention are accomplished by providing a toy having a spring-powered speed regulated mechanism, the speed regulating portion thereof including a cylinder having a closed end with a piston operable therein, the piston having sealing means about the periphery thereof with a minute orifice in the face of the piston and an enlarged aperture in the skirt of the piston with the two apertures being on opposite sides of the seal. The piston is provided with a centrally disposed axially extending rod member projecting out from the open end of the cylinder. A coupling member is secured to the rod member for simultaneous movement therewith. A torsion spring is operatively connected to the coupling member with the torsion spring being cocked by means of a handle pivotally mounted on the toy. The spring power resisted by the piston and cylinder regulates the speed of movement of the coupling member for regulating the movement of a moveable component of the toy.

The toy is in the form of a wheel loader construction toy having a scoop or bucket as the movable component which is operable from a lowered position to an elevated position through an articulated linkage arrangement enabling the bucket to be dumped at the elevated position. A slidable member is provided within the toy, the slidable member being connected to the torsion spring for being directly powered thereby. The slidable member is provided with a rack portion for operating the articulated shovel arrangement with the other end of the slidable member being coupled for simultaneous movement with the coupling member. A manually operable locking lever is mounted within the toy for coacting with the coupling member to retain the coupling member in the withdrawn position against the force of the torsion spring. Release of the locking lever enables the slidable member and consequently the coupling member to be urged toward its normal position with the piston and cylinder regulating the flow of air from within the closed ended cylinder through the orifice of the piston to the atmosphere to thereby regulate the movement of the shovel to simulate the smooth movement of the real object.

Other objects, features and advantages of the invention will become apparent from a reading of the specification when taken in conjunction with the drawings in which like reference numerals refer to like elements in the several views.

DESCRIPTION OF THE PREFERRED EMBODIMENT

Figure 1:
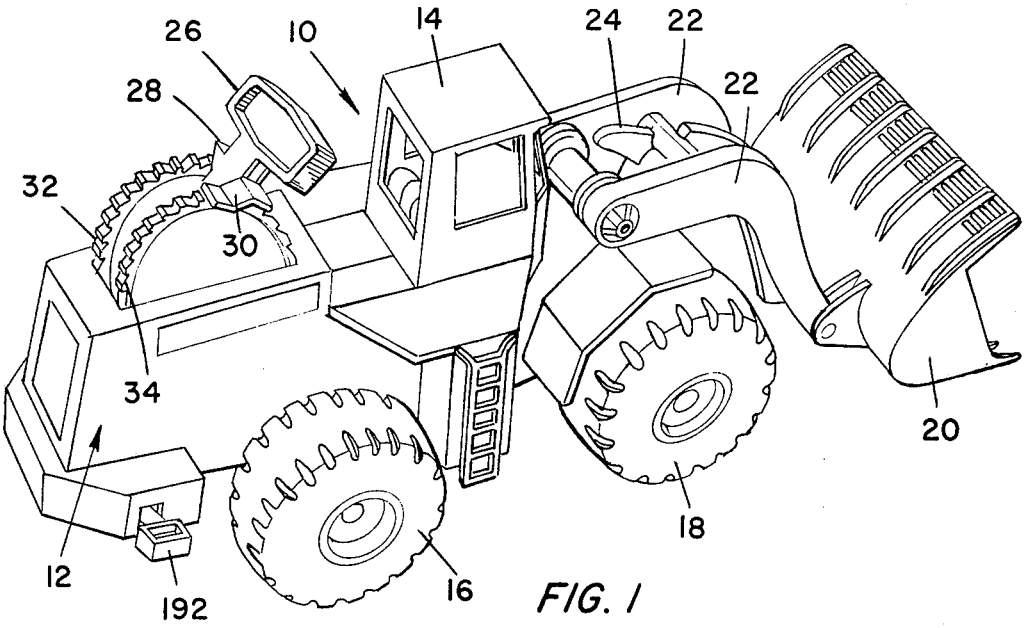
FIG. 1 is a perspective view of the wheel loader according to the invention.

Referring now to the drawings and particularly to FIG. 1, there is shown a toy in the form of a wheel loader generally designated 10, the wheel loader 10 having a body generally designated 12 with a cab portion 14, the body 12 being adapted for rollingly engaging a surface by means of two pairs of simulated tires 16 and 18, with the front end of the wheel loader 10 having a bucket or shovel 20 pivotally coupled to the front end of the body 12 by means of a first pair of generally parallel arm members 22 with a centrally disposed linkage 24 configured for tilting the shovel 20 at the top of its travel. The toy wheel loader 10 is configured externally to realistically depict the conventional wheel loader utilized in the construction industry with the operation of the shovel 20 likewise simulating the actual model. For the purpose of operating the toy wheel loader 10 a handle 26 is pivotally mounted to the body 12 with the handle 26 being provided with oppositely disposed pawl portions 28 and 30 for coacting with ratchet teeth 32 and 34 respectively during movement of the handle 26 in the forward or reverse direction as determined by the child. The ratchet teeth 32 and 34 are disposed about the circumference of generally circular wall portions with the teeth of ratchet 32 being directed in the direction opposite to the teeth of ratchet 34 as will hereinafter be described. In either event, the pawl members 28 and 30 permit the detenting along the respective ratchet surface 32 or 34 for locking the handle 26 in a predetermined or given position.

Figure 2:
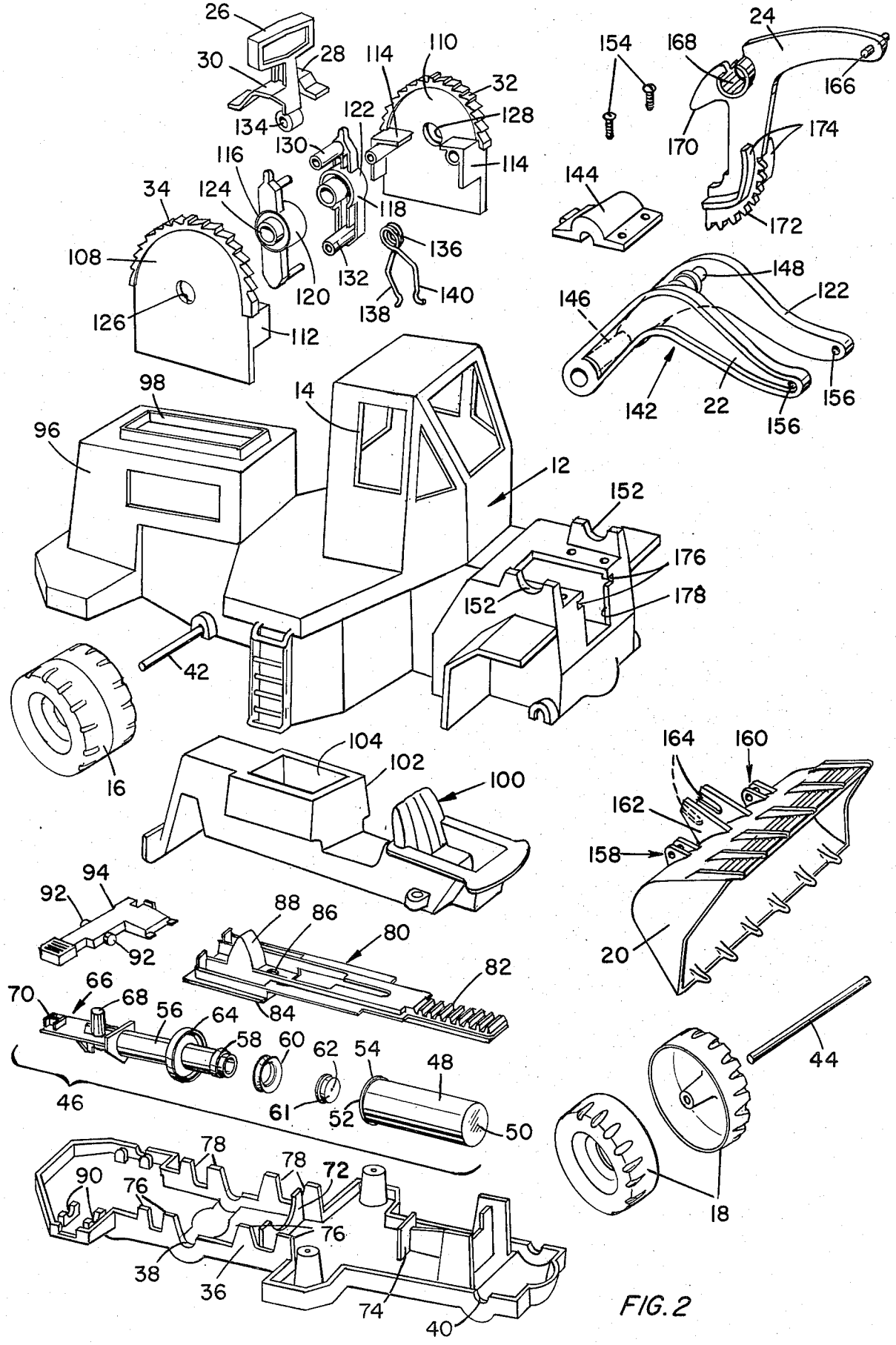
FIG. 2 is an exploded perspective view of the wheel loader of FIG. 1 illustrating the components of the spring-operated speed regulated motor mechanism.

Referring now to FIG. 2, the details pertaining to the individual components of the wheel loader 10 will be described. The wheel loader 10 includes a chassis member 36 having axle receiving portions 38 and 40 which receive axles 42 and 44 respectively, these axles having tires 16 and 18 rotatable secured to the free ends thereof. The wheels or tires 16 and 18 are freely rotatable and with the body member 12 mounted on the chassis 36 the toy can be moved by simply pushing on a surface.

A speed-regulating mechanism, generally designated 46 is mounted within the chassis 36, the regulating mechanism 46 having a piston assembly slidable within a cylinder, similar to a dashpot assembly. The cylinder 48 has a closed end 50 and an open end 52 with an enlarged flange 54 about the periphery of the open end 52. The cylinder 48 is of generally uniform internal diameter for receiving the piston assembly therein, the piston assembly including a piston plunger rod 56 having an enlarged generally hollow head end 58 which is closed by a piston cap 62 having a centrally disposed aperture or minute orifice 61 therein. The enlarged end 58 is encircled by a piston seal 60 with the skirt of the piston being provided with an enlarged aperture 63 communicating with the hollow interior of the enlarged end 58 on the opposite side of the seal 60. In this manner, the minute orifice 61 is in communication with the chamber formed between the piston head or cap 62 and the closed end 50 of the cylinder 48 to enable the flow of air in regulated amounts through the orifice 61 and thence through the skirt aperture 63 to provide an air "bleeding" effect. The piston plunger rod 56 is generally circular in cross section with a rubber cap or seal 64 having an aperture therethrough encircling the rod 56. The seal 64 may be in the form of a disc to operate as a dust seal, or may be configured for fitting over the flange 54 of the open end 52 of the cylinder 48. Secured to the rear end of the piston plunger rod 56 is a coupling member generally designated 66 which is generally bar-shaped with an upwardly extending generally frusto-conical projection 68 adjacent rod 56 with the free end of coupling member 66 having a locking projection 70 formed thereon. With the speed regulating mechanism 46 assembled (see also FIG. 3) it is retained on chassis 36 with the cylinder 48 between upwardly extending generally parallel frame member 72 and 74, the closed end 50 of cylinder 48 abutting against the interior of the frame member 74 with the rubber gasket or dust seal 64 abutting against the facing surface of frame member 72 for retaining the cylinder 48 in fixed position within the framework.

The chassis 36 is provided along the side edges thereof with a plurality of pairs of opposing projections 76 and 78 the upper edges of which define a plane for slidably receiving thereon a slidable member generally designated 80. The slidable member 80 is generally bar-shaped with a rack portion 82 adjacent one end thereof. The other end is provided with outwardly extending flanges 84 which ride on the tips of the projections 76 and 78. Intermediate the flanges 84 is a centrally disposed aperture 86 configured for engagement with the projection 68 on the coupling member 66. Disposed rearwardly of aperture 86 is an upwardly extending projection 88 disposed along the longitudinal center line of slidable member 80 with the projection 88 having arcuate surfaces terminating at a point with a generally triangular side elevational configuration.

The rearward portion of the interior chassis 36 is provided with a pair of aligned upwardly extending bosses 90 configured for pivotally receiving projections 92 of a locking lever generally designated 94. As will hereinafter be discussed, the locking lever 94 is configured for coacting with the locking projection 70 of the actuating member 66.

The body 12 has an upwardly extending generally rectangular portion 96 at the rear end thereof, the upper surface of portion 96 having a generally rectangular opening 98 for receiving the actuating mechanism. A chassis subassembly 100 having a simulated seat portion is configured for positioning within the interior of body member 12, the chassis subassembly 100 having a rectangular portion 102 with a rectangular opening 104 configured for alignment with the opening 98 in the box like portion 96 of the body member 12.

The actuating mechanism or handle assembly includes a pair of opposing plate like members 108 and 110 with the upper edges thereof being configured to form the ratchet edges 32 and 32 respectively. The members 108 and 110 have formed on the interior thereof inwardly extending mating aligned boss portions 112 and 114 respectively for securing the members 108 and 110 in spaced relation for receiving the handle operating mechanism. The mechanism includes a pivotable member comprised of parts 116 and 118 each of which has a central enlarged portion 120 and 122 respectively which have outwardly extending pivot shaft projections 124 thereon for defining a pivot axis, the shaft projections 124 being received within apertures 126 and 128 of the members 108 and 110 respectively. When assembled, the pivotable handle member formed from members 116 and 118 has diametrically opposed shaft portions 130 and 132, the shaft portion 130 being configured for passing through an aperture 134 in the handle member 26, thereby enabling the handle 26 to have limited pivotable movement relative to the pivotable member composed of assembled parts 116 and 118. The central shaft 120 passes through the opening of a torsion spring 136 which has the arms 138 and 140 thereof suitably bent for passing about the shaft projection 132 (See also FIG. 3), the torsion spring 136 providing the primary motive power for the mechanism. The torsion spring 136 has the arms 130 and 140 thereof in crossing relation with each arm being suitably bent to accomodate the position of shaft portion 132 for enabling the "cocking" of the spring 136 as will be described.

Still referring to FIG. 2, the shovel mechanism includes the shovel 20, the parallel arm assembly generally designated 142, the linkage 24 and a securing plate 144. The arm assembly 142 is configured in one piece with the arms 22 being generally L-shaped in side elevation with interconnecting first and second shafts 146 and 148 interconnecting the arms 22. The shaft 146 is positioned adjacent and interconnects one end of the arms 22, the shaft 146 being positioned in journals 150 and 152 formed on the front end of body 12 with the plate member 144 being positioned over shaft 146 with screw members 154 passing through plate member 144 for pivotally securing shaft 146 to the front end of body 12. The free ends of arms 22 are provided with apertures 156, the free end of each arm 22 being configured for being received between opposing pairs of lugs 158 and 160 formed on the bottom of shovel 20 with each pair of lugs 158 and 160 having apertures extending therethrough for receiving a suitable fastener which passes through the lugs and through the aperture 56 of arm 22 for pivotally securing shovel 20 relative to the arms 22.

Centrally disposed on the under surface of shovel 20 is a pair of generally triangular plate portions 162 in parallel relation generally perpendicular to the surface of shovel 20 with the plate portions 162 being generally elongate and having formed on the inner surfaces thereof aligned facing slots 164, the slots 164 being configured for receiving oppositely disposed pin projections 166 formed at one end of linkage 24. The linkage 24 is generally Z-shaped and provided with a journal portion 168 which is configured for a snap-fit pivotal engagement with the shaft 148 of the arm assembly 142. Extending rearwardly of the journal portion 168 of linkage 24 is an arcuate arm member 170 which lies generally in the plane of linkage 24 and configured for extending rearwardly for reinforcement of the integrally formed journal portion 168. The linkage 24 can be described as having an upper bar portion, a cross bar and a lower bar portion configured in the shape of a "Z", with the journal portion 168 at the juncture of the upper bar and cross bar and the arcuate member 170 located downwardly therefrom on the rear surface of the cross bar. The elbow formed by the juncture of the cross bar and lower bar is provided with a sector gear segment 172 in the plane of the linkage 24 with outwardly extending guide flanges 174 extending generally perpendicular thereto in opposite direction from the intermediate gear segment 172. The flanges 174 are configured for fitting within slots 176 formed within the side walls of the front opening 178 of the body 12, the gear segment 172 with the parts assembled being configured for coacting with the rack portion 82 of the slidable member 80.

Figure 3:
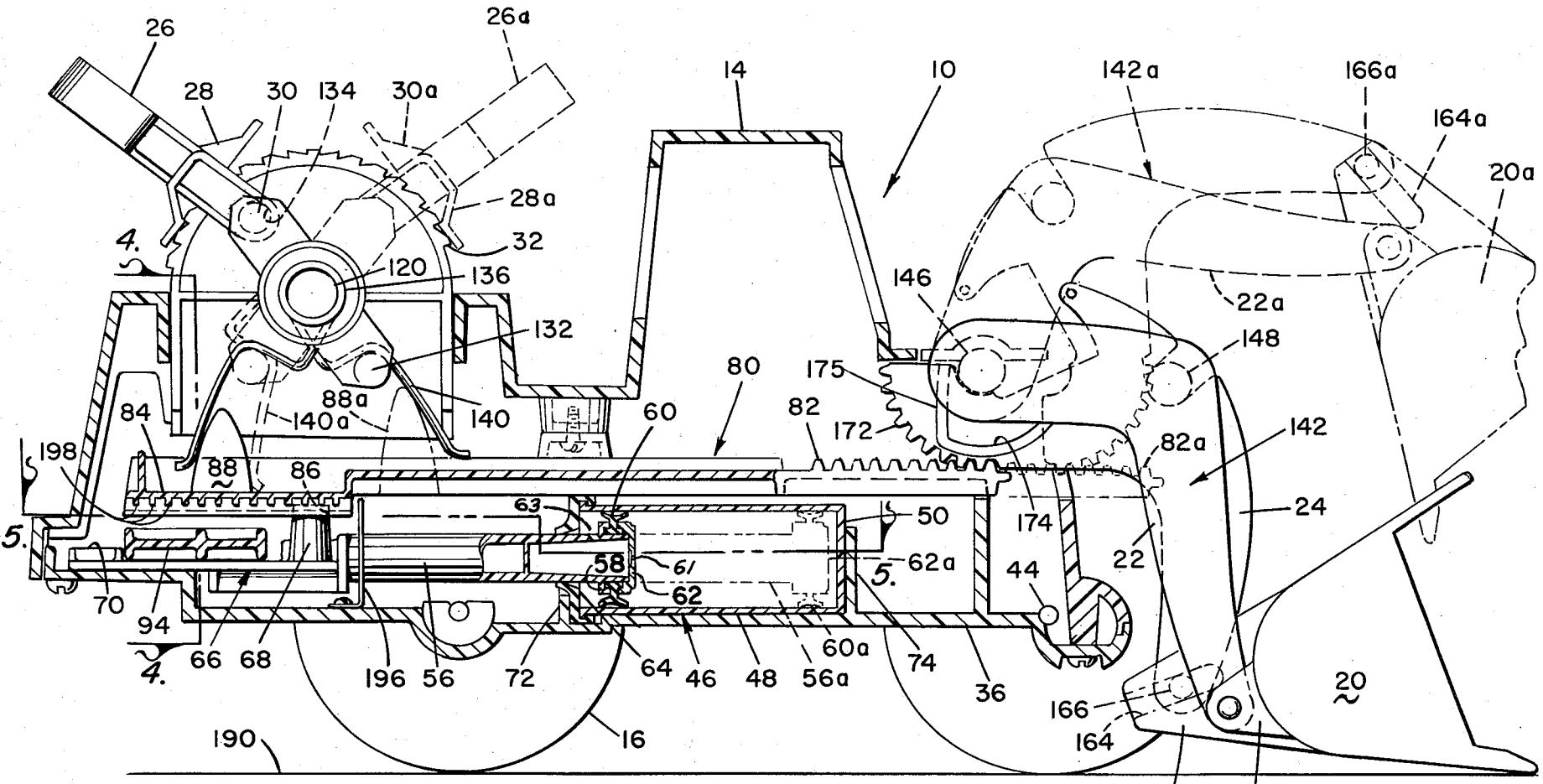
FIG. 3 is a side elevational view of the wheel loader of FIG. 1, partially in cross-section and partially broken away to illustrate the interior components thereof with certain portions shown in dotted lines as well as solid lines to depict the operation.

Referring now to FIG. 3, the toy wheel loader 10 is shown in assembled condition in side elevation with one half the body 12 removed to depict the interior layout. Certain components are shown in solid lines and dotted lines with the solid line component being designated by the reference numeral with the dotted line component of the same item being designated by the same reference numeral followed by the letter "a". The solid and dotted line positions being selected to depict the opposite ends of movement of the various components. The speed regulating mechanism 46 has the piston assembly thereof assembled and inserted within the cylinder 48 with the rubber seal 64 encircling the piston plunger rod 56 with the seal 64 engaging the flange 54. This assembly is positioned between the frame members 72 and 74 and snap-fit in place with the coupling member 66 extending rearwardly for sliding over the planar surface formed at the rear of the interior of the chassis 36. In FIG. 3, the solid line position of the speed regulating mechanism 46 corresponds to the fully actuated position wherein the locking lever 94 is engaging the locking projection 70 of the coupling member 66 for retaining the piston plunger rod 56 in the withdrawn position. The slidable member 80 is then positioned to slide on the tips of the projections 78 for sliding in a plane generally parallel to the plane of a surface 190 on which the toy vehicle 10 is resting. The projection 68 extends into the aperture 86 of the slidable member 80 to provide concurrent movement of slidable member 80 with coupling member 66 as will hereinafter be described. The handle mechanism is assembled with members 108 and 110 in parallel facing relation with the pivotable member consisting of parts 116 and 118 assembled therebetween with handle 26 pivotally mounted thereon with the torsion spring 136 likewise assembled on shaft 120 with spring arms 138 and 140 positioned on opposite sides of shaft 132. During this assembly, the spring arms are positioned on opposite sides of projection 88 of slidable member 80 to provide a spring coupling between the handle assembly and the slidable member 80. When assembled, the gear segment 172 of the linkage 24 of the shovel assembly is positioned for engagement with the rack portion 82 of slidable member 80 so that with the slidable member 80 in the fully operative position as shown in solid lines in FIG. 3, the shovel 20 is at its lowermost position as shown in solid line.

The shovel assembly is secured in the following manner. The arm assembly 142 is pivotally secured with reference to the body 12 by means of pivot axle or shaft 146 with the shovel 20 being pivotally secured to the free ends of arms 22 by means of the apertures 156 having passing therethrough a suitable fastener for engaging the pairs of lugs 158 and 160. The center arm or linkage 24 is pivotally coupled to shaft 148 of the arm assembly 142 with the pivot projections 166 at one end thereof sliding within slot 164 of the centrally disposed parallel plate portions 162. The opposite end of the linkage 24 having the gear segment 172 thereabout has the movement thereof only partially constrained by the guide flanges 174 operating within slots 176, the inner surface of this end being cut away to provide clearance with the pivot shaft 146 of the arm assembly 142. As the slidable member 80 moves from the extreme left solid line position to the extreme right dotted line position, the rack 82 pivots the gear segment 172 in a counterclockwise position until the arm assembly **142*a* is in the upper dotted line position with the dotted line shovel 20*a*** tilted until the opening thereof is facing downwardly for discharging the contents.

In the fully operated position the shovel **20*a* will be in the dotted line position with the rack portion 82*a* in the extreme right position and the piston correspondingly in the dotted line position designated 60*a* within the cylinder 48**.

To activate the spring-powered motor mechanism, the handle 26 is moved from the solid line position to the dotted line position designated **26*a* whereupon the leading spring arm 140 engages the front surface of the projection 88 of slidable member 80 to thereby move the projection from the dotted line position 88*a* to the solid line position shown in FIG. 3. During this movement, the coupling member 66 is drawn to the left as viewed in FIG. 3 with the piston assembly likewise moving left from the dotted line position to the solid line position. During this movement, air is drawn into the cylinder 48 from the chamber to the left of the piston through aperture 63 through the orifice 61 of piston cap 62, this air entering the chamber formed to the right of piston cap 62. As slidable member 80 moves, the rack portion 82 thereof engaging the gear segment 172 rotates the shovel assembly from the dotted line position to the solid line position. As the handle 26 is moved from the solid line position to the dotted line position 26*a*, the movement of the piston within the cylinder 48** is the only source of resistance.

Figure 5:
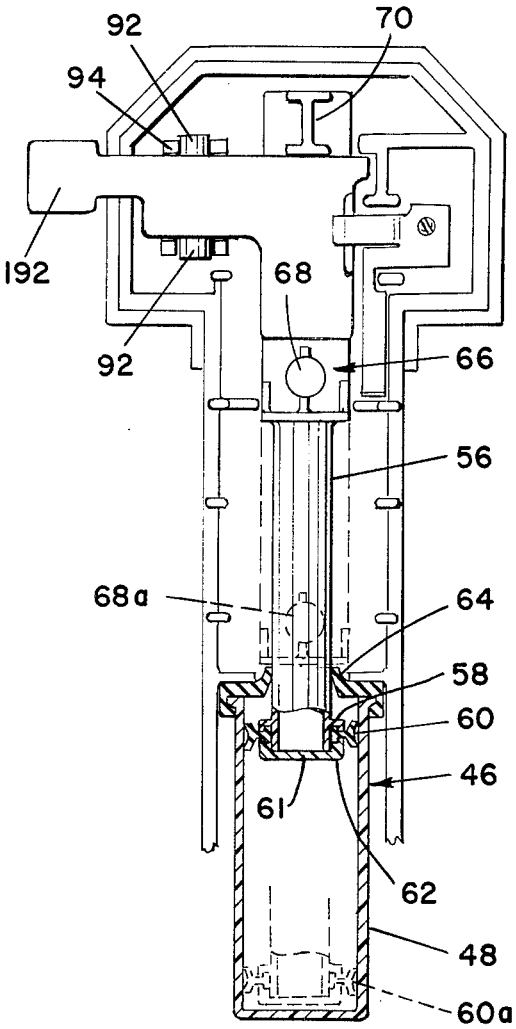
FIG. 5 is a plan view of the speed regulating mechanism as viewed generally along Line 5—5 of FIG. 3.
Figure 4:
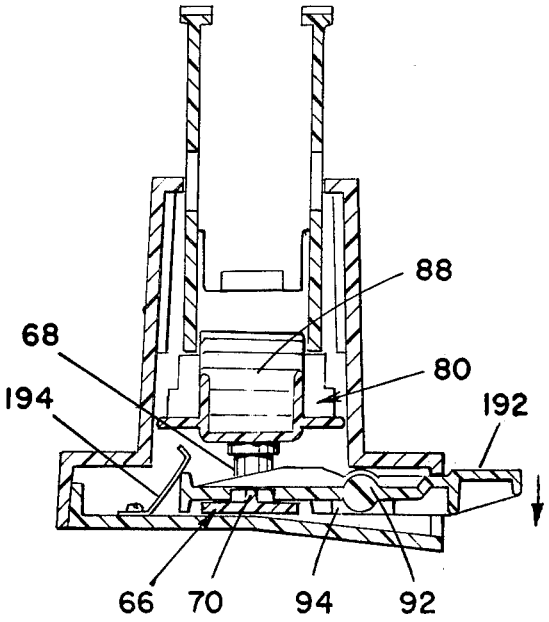
FIG. 4 is a cross-sectional view taken generally along Line 4—4 of FIG. 3.

With the piston plunger rod 56 fully withdrawn along with coupling member 66, the locking lever 94 is pivoted upwardly by manual depression of tab 192 on the end thereof so that the locking projection 70 is positioned rearwardly of the main body portion of locking lever 94 thereby retaining coupling member 66 in a fully cocked position. By reference to FIG. 5, the slidable member has been removed to illustrate the fully operative position in solid lines of the speed regulating mechanism 46. Referring also to FIG. 4 a spring member 194 is positioned in the rear portion of the chassis 36 for engaging the free end of locking lever 94 for retaining the locking lever 94 in a clockwise position as viewed in FIG 4 out of engagement with the locking projection 70. As the actuating member 66 is withdrawn, the locking lever 94 is then pivoted to the line position shown in FIG. 4 for keeping the coupling member 66 in its fully retracted position.

In this position the scoop or shovel 20 is positioned for riding along surface 190 (see also FIGS. 1 and 3). At this point, the component parts are in the positions shown in solid lines in FIG. 3. The handle 26 is then manipulated from the dotted line position 26*a* to the solid line position 26 for the purpose of cocking the spring powered mechanism, with the pawl 30 thereof engaging the ratchet teeth 34 for detenting and locking the handle 26 in the solid line position. In this position, the shaft 132 of the pivotable member spreads torsion spring arm 140 relative to the arm 138 to thereby provide spring power to provide motive power for the return of slidable member 80 once the locking lever 94 is pivoted to the release position. The handle 26 is pivotally coupled to the handle assembly to permit a slight degree of override for locking either of the pawls 28 or 30 although the pawls are stationary relative to the handle 26. Normally, the crossed torsion spring arms 138 and 140 are closely spaced on either side of shaft 132 with the particular configuration creating a flexible coupling with the projection 88 of slidable member 80 while providing spring power for operating the mechanism.

With the parts as shown in solid lines in FIG. 3, the arm 138 of torsion spring 136 is urging against projection 88 to urge slidable member 80 to the right as viewed in FIG. 3. As the locking lever 94 is pivoted by depressing the tab 192 thereof, the main body portion of locking lever 94 is lifted out of engagement with locking projection 70 thereby permitting movement of the slidable member 80 under control of the piston assembly toward the dotted line position illustrated in FIGS. 3 and 5. During this return of the piston assembly, air slowly enters into the chamber between the rear seal 64 and the rear face of the piston by the bleeding of the air through orifice 61 and through aperture 63 for governing or controlling the rate of movement of the piston plunger rod 56 and consequently the coupling member 66, this gradual movement moving the rack 82 to the dotted line position 82*a* to thereby elevate the arm assembly 142 with a smooth gradual time-delayed motion to the dotted line position 142*a* thereby raising the shovel 20. At the upper limit of travel of the shovel 20 to the dotted line position 20*a* the linkage in the position 24*a* has the pivot pin projections 166*a* thereof moving within the slot 164*a* to thereby tilt the bucket 20*a* in a generally vertical direction to empty the contents thereof, thus simulating the operating movement in a time delayed manner similar to that of a conventional wheel loader. During the counterclockwise rotation of the linkage 24 of the shovel mechanism, the guide flanges 174 move within slots 176 of opening 178 to control the position of the free end of the linkage 24. This movement is governed by the contour of flange 174 which is generally arcuate for approximately one-half the length thereof with the rearward portion designated 175 being somewhat flattened, this flattened portion 175 when engaging slots 176 slowing down the rate of rotation of linkage 24 relative to the arms 22 thereby enabling the pivot pin projection 166 to slide within the slot 164 to provide the additional displacement required to tilt the bucket or shovel 20 to the dotted line position 20*a*.

To further enhance the amusement value of the wheel loader 10, a sound mechanism may optionally be provided, the sounding mechanism including a leaf spring member 196 secured within chassis 36, the free end of spring member 196 being positioned for coacting with a plurality of spaced downwardly extending nubs 198 on the undersurface of flange 84 of slidable member 80. During forward or reverse movement of slidable member 80 the nubs 198 engage the spring 196 intermittently for emitting a sound.

In brief, the spring-operated speed regulated mechanism utilizes a torsion spring having the arms thereof in crossing relation with a shaft portion 132 therebetween for spreading the arms 138 and 140 to provide a source of energy with the slidable member 80 locked in position through its coaction with coupling member 66 which is engaged by the locking lever 94. With the coupling member 66 direct coupled to the piston assembly operating within the cylinder 48, the speed regulating mechanism 46 enables the use of a torsion spring 136 having a relatively large spring force to dissipate the energy so stored in a speed regulated controlled manner to effect a smooth motion of the operative components of the toy such as the shovel 20 with the articulated connection coupled thereto. By judicious selection of the size of the cylinder 48 along with the dimensions of the piston assembly and the orifice 61 and aperture 63, the rate of movement of the parts may be precisely controlled in a straightforward relatively uncomplicated mechanism. The mechanism may likewise be employed in other toys to provide a simulated time delay for operating movable components of the toy gradually or smoothly under force of a spring member with the movable components operatively controlled in the rate of movement by the speed regulating mechanism hereinabove shown and described. It is to be understood that the foregoing description is by way of illustration in a specific toy and it is not intended to be limited to such. Other means may be coupled for operation by the coupling member 66 or actuating rod 56, such other means taking any other convenient form such as gears, pulleys, cables, or level linkages, any of which may be readily adaptable to the particular device in which the spring operated speed regulated motor mechanism is to be used to provide a smoothly flowing motion to the movable components of the toy to simulate a hydraulic or pneumatically operated device.

While there has been shown and described a preferred embodiment it is to be understood that various other adaptations and modifications may be made within the spirit and scope of the invention.

What is claimed is:

1. In a toy, the combination comprising:

a supporting structure;

a component attached to said structure for movement relative thereto;

handle means movably mounted on said supporting structure;

a member mounted for slidable movement within said structure, said member being operatively connected to said component to effect movement of the component;

spring means operatively interconnecting said handle means and said member for sliding said member in a first direction to a predetermined position in response to movement of said handle means;

means for retaining said member in said predetermined position against the force of said spring means whereby said spring means may be cocked; and speed regulating means operatively coupled to said member for controlling the rate of movement of said member in a direction opposite to said first direction upon release of said retaining means for controlling the speed of movement of said component.

2. The combination according to claim 1 wherein said speed regulating means includes a cylinder having a closed end with a piston slidable axially within said cylinder.

3. The combination according to claim 2 wherein said speed regulating means includes a seal about the periphery of said piston with a minute aperture in the face of the piston and another aperture in the skirt thereof on the side of said seal opposite the face, said apertures controlling the rate of flow of air from within the cylinder in the chamber formed between the closed end thereof and said piston face.

4. The combination according to claim 1 wherein said handle means is manually operable between first and second positions, and said spring means and said handle means are so configured that movement of said handle means to said first position slides said member in a first direction and movement of said handle means to said second position cocks and spring means with said retaining means engaged.

5. The combination according to claim 4 wherein said speed regulating means includes a piston slidable axially within a closed ended cylinder.

6. The combination according to claim 5 wherein said piston is provided with a seal about the periphery thereof, a minute aperture in the face thereof and a larger aperture in the skirt thereof with said apertures being on opposite sides of said seal for regulating the flow of air through said apertures during movement of said member in a direction opposite to said first direction.

7. The combination according to claim 4 wherein said handle means includes a handle pivotable about a pivot shaft with a shaft portion in spaced relation to said pivot shaft, and said spring means is a torsion spring encircling the pivot shaft with first and second arms in crossing relation on either side of said shaft portion, and said slidable member includes a projection configured for being received between the free ends of said spring arms for providing the operative interconnection between said handle means and said member, pivoting of said handle to said second position with said retaining means engaged causing said shaft portion to spread said spring arms for providing the spring force.

8. In a toy construction vehicle, the combination comprising:

a supporting structure;

an arm assembly having one end thereof pivotally coupled to said supporting structure;

a shovel-shaped component pivotally coupled to the other end of said arm assembly;

a linkage pivotally coupled to said arm assembly and having one end thereof coupled to said shovel-shaped component for relative movement therebetween;

handle means moveably mounted on said supporting structure;

a member mounted for slidable movement within said structure, said member being operatively connected to the other end of said linkage for pivoting said linkage in response to movement of said member;

spring means operatively interconnecting said handle means and said member for sliding said member in a first direction to a predetermined position in response to movement of said handle means;

means for retaining said member in said predetermined position against the force of said spring means whereby said spring means may be cocked; and speed regulating means operatively coupled to said member for controlling the rate of movement of said member in a direction opposite to said first direction upon release of said retaining means for controlling the rate of pivoting of said linkage.

9. The combination according to claim 8 wherein said speed regulating means includes a cylinder having a closed end with a piston slidable axially within said cylinder.

10. The combination according to claim 9 wherein said speed regulating means includes a seal about the periphery of said piston with a minute aperture in the face of the piston and another aperture in the skirt thereof on the side of said seal opposite the face, said apertures controlling the rate of flow of air from within the cylinder in the chamber formed between the closed end thereof and said piston face.

11. The combination according to claim 9 wherein said piston includes an axially extending rod member and a coupling member secured to said rod member, said retaining means being configured for coacting with said coupling member.

12. The combination according to claim 11 wherein said slidable member includes a rack portion and said linkage includes a gear segment coacting with said rack portion for pivoting said linkage in response to movement of said slidable member.

* * * * *